US009955744B1

(12) United States Patent
Yanes et al.

(10) Patent No.: US 9,955,744 B1
(45) Date of Patent: May 1, 2018

(54) PINNED PLATE ASSEMBLY

(71) Applicants: Daniel Francisco Yanes, Miami, FL (US); Miguel Angel Yanes, Miami, FL (US); Isabelie Yanes, Miami, FL (US)

(72) Inventors: Daniel Francisco Yanes, Miami, FL (US); Miguel Angel Yanes, Miami, FL (US); Isabelie Yanes, Miami, FL (US)

(73) Assignees: Daniel Francisco Yanes, Miami, FL (US); Miguel Angel Yanes, Miami, FL (US)

( * ) Notice: Subject to any disclaimer, the term of this patent is extended or adjusted under 35 U.S.C. 154(b) by 568 days.

(21) Appl. No.: 14/634,023

(22) Filed: Feb. 27, 2015

Related U.S. Application Data

(63) Continuation-in-part of application No. 14/256,322, filed on Apr. 18, 2014, now Pat. No. 9,259,045.

(51) Int. Cl.
*A44C 3/00* (2006.01)
*A42B 1/24* (2006.01)
*A44C 5/20* (2006.01)

(52) U.S. Cl.
CPC ..... *A42B 1/248* (2013.01); *A44C 5/2052* (2013.01)

(58) Field of Classification Search
CPC ..... Y10T 24/13; Y10T 24/1365; Y10T 24/45052
USPC ... 40/622, 658, 666, 1.5, 1.6, 586, 329, 668, 40/661.04
See application file for complete search history.

(56) References Cited

U.S. PATENT DOCUMENTS

| | | | | |
|---|---|---|---|---|
| 2,067,526 | A * | 1/1937 | Graham | G09F 3/18 40/314 |
| 3,735,447 | A | 5/1973 | Abraham | |
| 4,261,121 | A * | 4/1981 | Coon | A47G 25/485 223/96 |
| 6,122,805 | A | 9/2000 | Haegley | |
| 6,178,680 | B1 | 1/2001 | Sloot | |
| 6,675,512 | B1 | 1/2004 | Shwartz et al. | |
| 6,694,526 | B1 * | 2/2004 | Tate | A42B 1/24 2/209.12 |
| 6,701,649 | B1 | 3/2004 | Brosi | |
| D558,955 | S | 1/2008 | Taylor | |
| D603,584 | S | 11/2009 | Porter | |
| 7,640,636 | B2 | 1/2010 | Clark | |
| 8,001,661 | B2 | 8/2011 | Clark | |

(Continued)

FOREIGN PATENT DOCUMENTS

WO 2005120266 A1 12/2005

*Primary Examiner* — Joanne Silbermann
(74) *Attorney, Agent, or Firm* — Albert Bordas, P.A.

(57) ABSTRACT

A pinned plate assembly having a plate assembly made of a flexible and bendable semi rigid material that maintains its shape once configured. The plate assembly has an exterior face, an interior face, first and second edges, and first and second lateral edges. The plate assembly further has first and second channels, each having at least one hole. Securing means secure the plate assembly onto headgear. In a preferred embodiment, the plate assembly has a substantially rectangular shape. The exterior face displays desired text, and/or letters, and/or symbols, and/or words, and/or logo designs, and/or artwork, and/or graphics. The first and second channels each have an exterior channel defined at the exterior face and an interior channel defined at the interior face. The at least one hole extends from the exterior channel to the interior channel.

18 Claims, 6 Drawing Sheets

(56) References Cited

U.S. PATENT DOCUMENTS

| | | | | |
|---|---|---|---|---|
| 2005/0091897 | A1* | 5/2005 | Lawrence | G09F 3/16 40/666 |
| 2008/0141440 | A1 | 6/2008 | Taylor | |
| 2008/0148528 | A1* | 6/2008 | Jones | A44C 3/001 24/3.3 |
| 2010/0064484 | A1 | 3/2010 | Clark | |

* cited by examiner

PINNED PLATE ASSEMBLY

OTHER RELATED APPLICATIONS

The present application is a continuation-in-part of pending U.S. patent application Ser. No. 14/256,322, filed on Apr. 18, 2014, which is hereby incorporated by reference.

BACKGROUND OF THE INVENTION

Field of the Invention

The present invention relates to headgear accessories, and more particularly, to plate assemblies for headgear.

Description of the Related Art

Applicant believes that one of the closest references corresponds to U.S. Patent Application Publication No. 20080141440 A1, published on Jun. 19, 2008 to Taylor for Headgear with a Projected Design Element. However, it differs from the present invention because Taylor teaches embodiments for a headgear, such as a hat or visor, that includes a top portion, a sidewall extending downwardly from the top portion, and a design element attached to and spaced apart from the sidewall. The design element has a front surface and a back surface. The back surface of the design element is adjacent, spaced apart from, and co-facing the sidewall, and the front surface of the design element faces outwardly from the sidewall. The design element is spaced apart from the sidewall using one or more rods that project from the sidewall. The design element may comprise a logo, one or more letters, one or more words, or one or more numbers.

Applicant believes that another reference corresponds to U.S. Patent Application Publication No. 20100064484 A1, published on Mar. 18, 2010 to Clark, and corresponding U.S. Pat. No. 8,001,661 B2 issued on Aug. 23, 2011 for Apparatus for Securing Ornamentation to Personal Items. However, it differs from the present invention because Clark teaches an ornamental device that includes a first member adapted to be coupled to a personal item. The first member has a first end having a sidewall. A second member is releasably engagable with the first member, and is provided with a recess that receives the first end of the first member when the first and second members are engaged. The second member has a flange that contacts the sidewall of the first member substantially along a width of the sidewall when the first and second members are engaged. The first and second members are magnetically coupled, such that the magnetic interaction, and the interaction of the flange with the sidewall, secures a decorative second member to a personal item in a selected location.

Applicant believes that another reference corresponds to U.S. Pat. No. 7,640,636 B2 issued to Clark on Jan. 5, 2010 for Apparatus for Securing Ornamentation to Personal Items. However, it differs from the present invention because Clark teaches an ornamental device that includes a first member adapted to be coupled to a personal item. The first member has a first end having a sidewall. A second member is releasably engagable with the first member, and is provided with a recess that receives the first end of the first member when the first and second members are engaged. The second member has a flange that contacts the sidewall of the first member substantially along a width of the sidewall when the first and second members are engaged. The first and second members are magnetically coupled, such that the magnetic interaction, and the interaction of the flange with the sidewall, secures a decorative second member to a personal item in a selected location.

Applicant believes that another reference corresponds to U.S. Pat. No. 6,701,649 B1 issued to Brosi on Mar. 9, 2004 for Combat Identification Marker. However, it differs from the present invention because Brosi teaches a marker for attachment to a helmet head covering or the like of a friendly force member, and more particularly to an on-the-go hand securable marker having at least one extension with a retaining head for inserting into a hole in the uniform with the retaining head sufficiently rigid to prevent withdrawal therefrom under field conditions with the marker having a limited wavelength reflective surface thereon to enable a person observing under nighttime conditions to determine if a person is a friendly force member by the presence of reflections of electromagnetic radiation from the marker on the friendly force member. If field conditions change one can quickly remove the marker and replace the marker with conventional camouflage materials.

Applicant believes that another reference corresponds to U.S. Pat. No. 6,675,512 B1 issued to Shwartz, et al. on Jan. 13, 2004 for Display Assembly for Placement on Clothing Apparel. However, it differs from the present invention because Shwartz, et al. teaches a display assembly for placement on apparel. The assembly includes a flexible layer for placement against the apparel. The assembly further includes a display having pliable extension for penetrating across the flexible layer to securely position the display on the flexible layer. The assembly can be attached to the apparel, including a cap and visor by stitching or sewing the flexible layer to the apparel.

Applicant believes that another reference corresponds to U.S. Pat. No. 6,178,680 B1 issued to Sloot on Jan. 30, 2001 for Applique for Apparel and Method for Making the Applique. However, it differs from the present invention because Sloot teaches an applique and method for making it, wherein inner and outer vinyl sheets are welded together to form a decorative applique and wherein a pair of fastener are employed each having a flat segment that is embedded between the inner and outer vinyl sheets and has a stem that extends through the inner sheet, its outer located adhesive layer and overlying release liner. Caps are used to enable the applique to be affixed to a carrier card for shipment to an end user, who can then remove the caps and use the fasteners to affix the applique to apparel using the adhesive and re-use the fasteners. The combination of the adhesive and the fasteners enable a firm and sustaining attachment of the applique to surfaces having a low affinity to the adhesive employed on the inner layer.

Applicant believes that another reference corresponds to U.S. Pat. No. 6,122,805 A issued to Haegley on Sep. 26, 2000 for Device for Securing Ribbons to Military Uniform. However, it differs from the present invention because Haegley teaches a securing device to be located on the inside of a uniform garment to align and anchor military-type ribbon holders, nametags and warfare insignias. The securing device contains claps encased within a thin, soft, pliable plastic foam material sized slightly larger than the secured military-type ribbon holders, nametags and warfare insignias, yielding a flush appearance against the wearer's body. Repeated insertion to and retraction from my device can occur without concern for lost clasps or skin penetration.

Applicant believes that another reference corresponds to U.S. Pat. No. 3,735,447 A issued to Abraham on May 29, 1973 for Holder and Fastener. However, it differs from the present invention because Abraham teaches a device for holding an object and fastening same in a desired location. For example, the device may be used for securing a corsage or the like to an item of wearing apparel. The device includes a first element comprising a first body member adapted to have a corsage secured thereto and means defining a socket integrally connected to the first body member. The device further includes a second element comprising a second body member and fastener means in the form of pins projecting outwardly therefrom. When the device is used in conjunction with a corsage, the second element is adapted for disposition on the inside of the wearing apparel with the fastener pins adapted to pierce the wearing apparel and enter the socket of the first element to effect releasable engagement therebetween.

Applicant believes that another reference corresponds to U.S. Pat. No. D558,955 S issued to Taylor on Jan. 8, 2008 for Head Gear with Projecting Indicia. However, it differs from the present invention because Taylor teaches an ornamental design for a head gear with projecting indicia that is different from Applicant's invention.

Applicant believes that another reference corresponds to U.S. Pat. No. D603,584 S issued to Porter on Nov. 10, 2009 for Headwear Device. However, it differs from the present invention because Porter teaches an ornamental design for a headwear device that is different from Applicant's invention.

Applicant believes that another reference corresponds to PCT Publication No. WO 2005120266 A1 published by WIPO to Thompson on Dec. 22, 2005 to Taylor for Instant Wearable Cap Bill Shaper with Indicia. However, it differs from the present invention because Thompson teaches a curved cap bill shaper that has binding tabs, snaps, spikes, or adjustable snaps at each end binding the side edges of a cap bill to the bill shaper and imparting a desired curvature to the cap bill. Mating curved arms hinged to the bill shaper may adjustably interlock below the cap bill sandwiching it therebetween. Protruding points from the bill shaper and the arms may pierce or indent the cap bill. Indicia may be placed on a top surface of the bill shaper which covers or partly covers the cap bill.

Other patents describing the closest subject matter provide for a number of more or less complicated features that fail to solve the problem in an efficient and economical way. None of these patents suggest the novel features of the present invention.

SUMMARY OF THE INVENTION

The instant invention is a pinned plate assembly, comprising a plate assembly made of a flexible and bendable semi rigid material that maintains its shape once configured. The plate assembly has an exterior face, an interior face, first and second edges, and first and second lateral edges. The plate assembly further comprises first and second channels, each comprising at least one hole. Securing means secure the plate assembly onto headgear. In a preferred embodiment, the plate assembly has a substantially rectangular shape.

The exterior face displays desired text, and/or letters, and/or symbols, and/or words, and/or logo designs, and/or artwork, and/or graphics. The first and second channels each comprise an exterior channel defined at the exterior face and an interior channel defined at the interior face. The at least one hole extends from the exterior channel to the interior channel. An advertising band section may be attached to the exterior face with removable/detachable means including hook and loop fasteners, magnets, silicone, and non-permanent glue or adhesives to also display desired text, and/or letters, and/or symbols, and/or words, and/or logo designs, and/or artwork, and/or graphics. The interior face comprises a reusable interior identification section, wherein personal dedications, and/or identification information, and/or emergency contact information, and/or special or medical conditions, and/or desired text, and/or letters, and/or symbols, and/or words, and/or logo designs, and/or artwork, and/or graphics may be placed thereon.

The securing means to secure the plate assembly onto the headgear comprises two post assemblies. The two post assemblies removably mount onto the first and second channels. Each of the two post assemblies comprises a backing. Extending from the backing is a post having a neck and a head at its distal end. The at least one hole of the first and second channels are of a cooperative shape and dimension to removably receive a respective head of the post therein. Positions of the at least one hole of the first and second channels are intended to coincide or complement a placement of eyelets in the headgear. The plate assembly mounts onto headgear without affecting integrity of the headgear by utilizing existing eyelets to receive the two post assemblies therethrough. More specifically, the plate assembly mounts onto the headgear when each respective at least one hole of the first and second channels are aligned with eyelets and from an interior section of the headgear crown. The two post assemblies pass through the eyelets until each respective at least one hole of the first and second channels receive its respective head. The first and second channels accommodate the headgear having eyelets of different dimensions, and distances from each other. The headgear is a soft cap with a rounded crown and a stiff peak projecting in front. The securing means to secure the plate assembly onto the headgear also comprises a tension arm assembly. The present invention further comprises an extension strap to wear in a bracelet configuration.

It is therefore one of the main objects of the present invention to provide a pinned plate assembly to mount onto headgear for customization.

It is another object of the present invention to provide a pinned plate assembly that mounts onto headgear without affecting the headgear's integrity by utilizing existing headgear eyelets to receive post assemblies therethrough.

It is another object of the present invention to provide a pinned plate assembly that comprises a plate assembly and a post assembly.

It is another object of the present invention to provide a pinned plate assembly that comprises a reusable advertisement band section to display desired text, and/or letters, and/or symbols, and/or words, and/or logo designs, and/or artwork, and/or graphics for headgear customization.

It is another object of the present invention to provide a pinned plate assembly that comprises reusable advertisement band section that is removably or permanently mounted onto the plate assembly.

It is another object of the present invention to provide a pinned plate assembly comprising a reusable interior identification section, wherein a user may write, print, or otherwise place thereon personal dedications, and/or identification information, and/or emergency contact information, and/or special or medical conditions, and/or desired text, and/or letters, and/or symbols, and/or words, and/or logo designs, and/or artwork, and/or graphics.

It is another object of the present invention to provide a pinned plate assembly comprising post assemblies to accommodate different headgear dimensions.

It is another object of the present invention to provide a pinned plate assembly that is volumetrically efficient for carrying, transporting, and storage.

It is another object of the present invention to provide a pinned plate assembly that can be readily assembled and disassembled without the need of any special tools.

It is another object of the present invention to provide a pinned plate assembly that is of a durable and reliable construction.

It is yet another object of this invention to provide such an assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
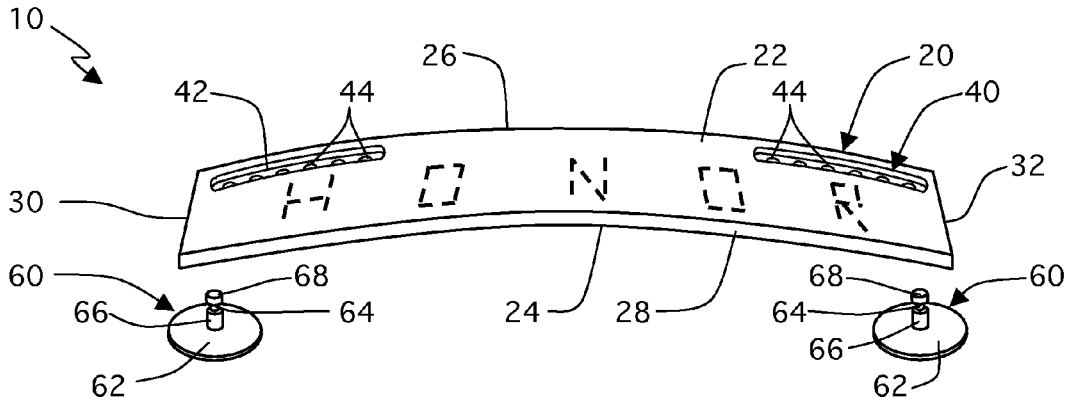
FIG. 1 is a front isometric view of the present invention disassembled.

Referring now to the drawings, the present invention is a pinned plate assembly and is generally referred to with numeral 10. It can be observed that it basically includes plate assembly 20 and post assemblies 60.

Figure 2:
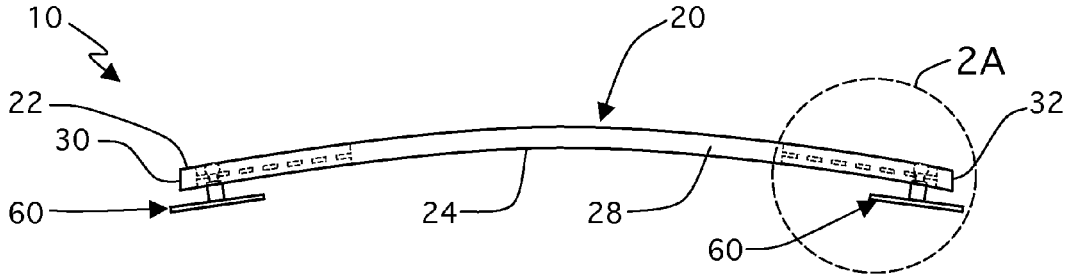
FIG. 2 is a side view of the present invention assembled.

As seen in FIGS. 1 and 2, in a preferred embodiment plate assembly 20 has a substantially rectangular shape. Plate assembly 20 has exterior face 22, interior face 24, edges 26 and 28, and lateral edges 30 and 32. Plate assembly 20 further comprises first and second channels 40, each having respective holes 44 to receive head 68 of a respective post assembly 60. In a preferred embodiment, plate assembly 20 is also reversible so that either exterior face 22 or interior face 24 may be exposed as desired by the user.

Figure 2A:
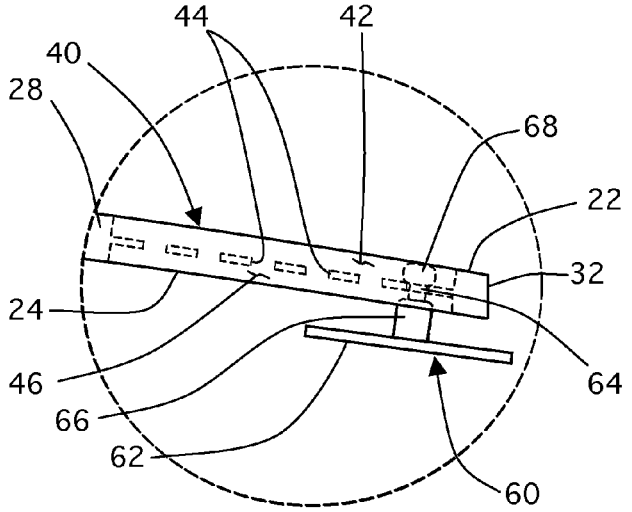
FIG. 2A is an enlarged view of a section of the present invention taken along line 2A from FIG. 2.

As seen in FIG. 2A, each post assembly 60 is removably mounted within its respective channel 40.

As best seen in FIG. 2A, each channel 40 comprises holes 44 that extend between exterior channel 42 and interior channel 46. Holes 44 have a cooperative shape and dimension to removably receive neck 64 therein, thus securing post assembly 60 in place.

Figure 2B:
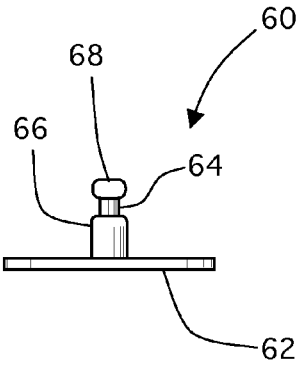
FIG. 2B is a side view of a post assembly.

As best seen in FIG. 2B, each post assembly 60 comprises backing 62. Extending from backing 62 is post 66 having neck 64 and head 68 at its distal end.

Figure 3A:
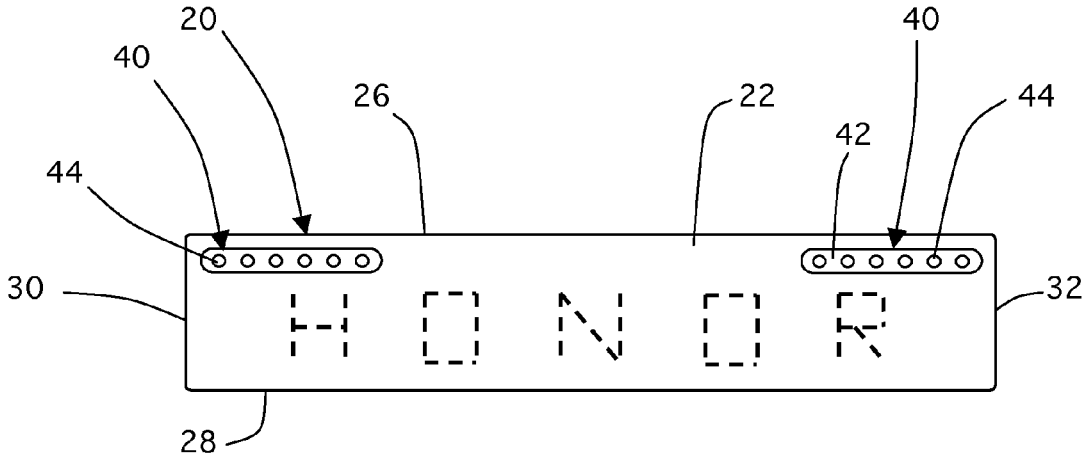
FIG. 3A is a front view of a plate assembly.
Figure 5A:
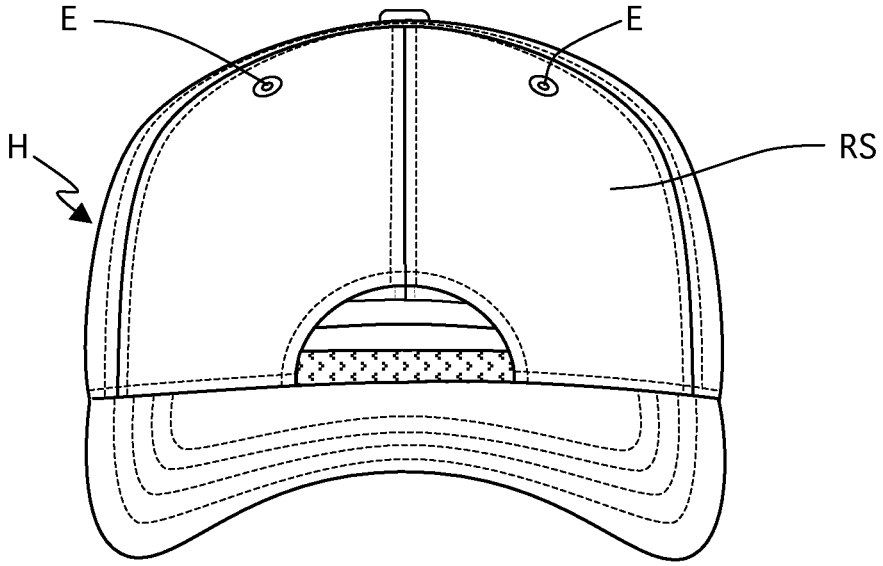
FIG. 5A is a first rear view of a headgear comprising eyelets.
Figure 5B:
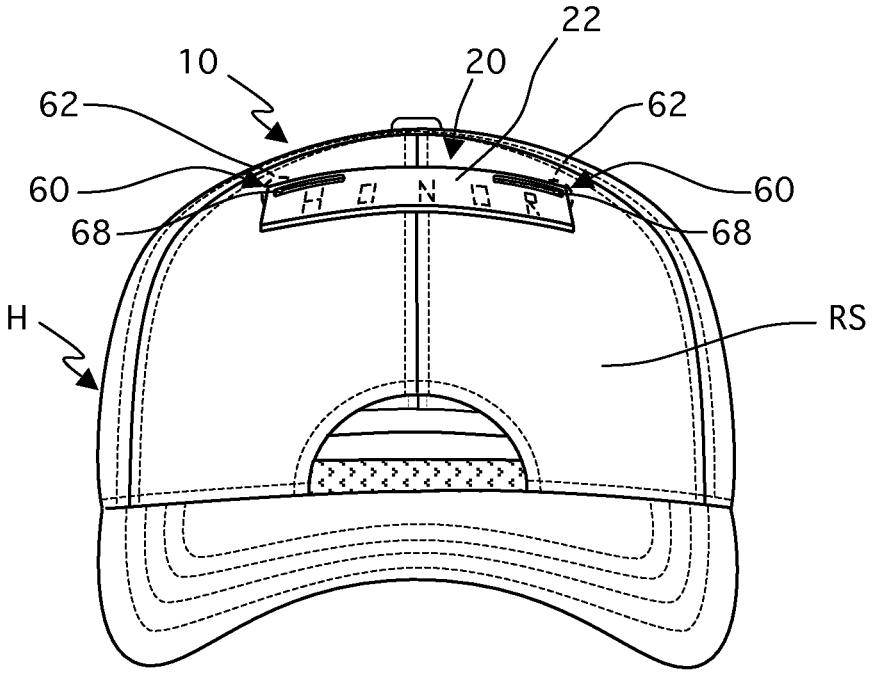
FIG. 5B is a second rear view of the headgear with the present invention mounted thereon.

As seen in FIG. 3A, exterior face 22 may have advertisement thereon to display desired text, and/or letters, and/or symbols, and/or words, and/or logo designs, and/or artwork, and/or graphics for headgear H customization, seen in FIG. 5B.

Figure 3B:
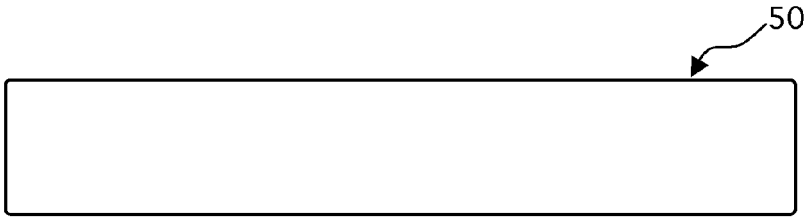
FIG. 3B is a front view of an advertising band section.

As seen in FIG. 3B, in an alternate embodiment, exterior face 22 may have advertising band section 50 attached thereon. As a separate band, the advertising band section may be attached to exterior face 22 with removable/detachable means such as hook and loop fasteners, magnets, silicone, and non-permanent glue or adhesives to also display desired text, and/or letters, and/or symbols, and/or words, and/or logo designs, and/or artwork, and/or graphics for headgear H customization.

Figure 4:
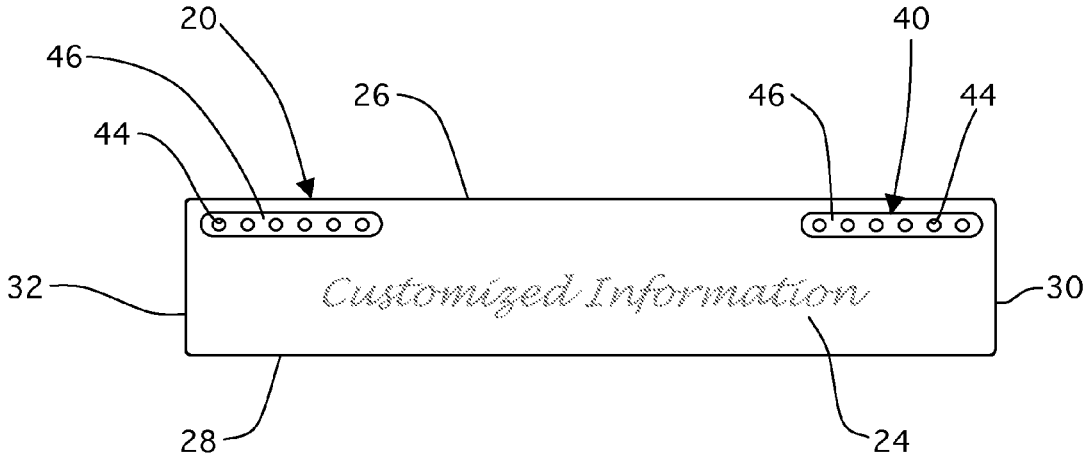
FIG. 4 is a rear view of the plate assembly.

As seen in FIG. 4, interior face 24 comprises an interior identification section. In a preferred embodiment, the interior identification section is reusable, wherein a user may write, print, or otherwise place thereon personal dedications, and/or identification information, and/or emergency contact information, and/or special or medical conditions, and/or desired text, and/or letters, and/or symbols, and/or words, and/or logo designs, and/or artwork, and/or graphics.

As seen in FIGS. 5A and 5B, headgear H comprises rear section RS having eyelets E. In a preferred embodiment, present invention 10 mounts onto headgear H without affecting the headgear's H integrity by utilizing existing eyelets E to receive post assemblies 60 therethrough.

As best seen in FIG. 5B, present invention 10 is mounted onto rear section RS of headgear H, whereby holes 44 are aligned with eyelets E, and from an interior section of the headgear H crown, posts 66 pass through eyelets E until each hole 44 receives its respective head 68. It is noted that a predetermined force is required for hole 44 to receive its respective head 68. Channels 40 accommodate to various styles of headgear H having eyelets E of different dimensions and distances from each other.

Figure 6A:
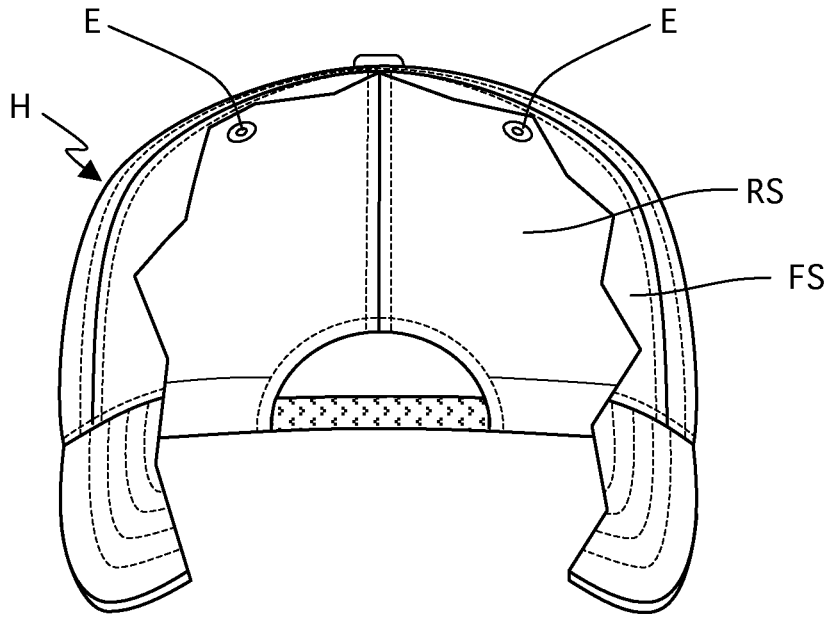
FIG. 6A is a first front view of the headgear partially cross-sectioned to show an interior section of the headgear crown.
Figure 6B:
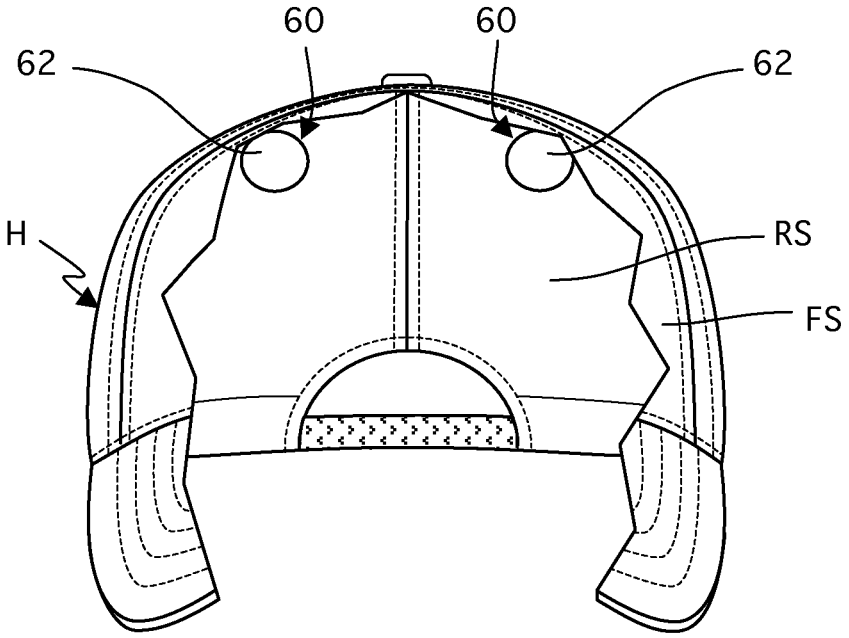
FIG. 6B is a second front view of the headgear partially cross-sectioned to show the interior section of the headgear crown and the present invention mounted thereon.

As seen in FIGS. 6A and 6B, headgear H also has front section FS. Present invention 10 may be mounted onto any section of headgear H having eyelets E. In addition, post assemblies 60 function to provide optimum comfort to the wearer since backings 62 will accommodate themselves to the shape of the wearer's head, as best seen in FIG. 6B.

In a preferred embodiment, headgear H is a baseball styled cap defined as a type of soft cap with a rounded crown and a stiff peak projecting in front. The front of the cap typically contains designs or logos of sports teams, namely baseball teams, or names of relevant companies, when used as a commercial marketing technique. The back of the cap may be "fitted" to the wearer's head size or it may have a plastic, "VELCRO", or elastic adjuster so that it can be quickly adjusted to fit different wearers. The baseball cap is a part of the traditional baseball uniform worn by players, with the brim pointing forward to shield the eyes from the sun. The cap is also often seen in everyday casual wear.

Figure 7A:
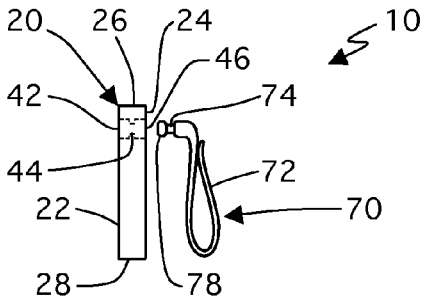
FIG. 7A is a first side view of a first alternate embodiment of the present invention disassembled.
Figure 7B:
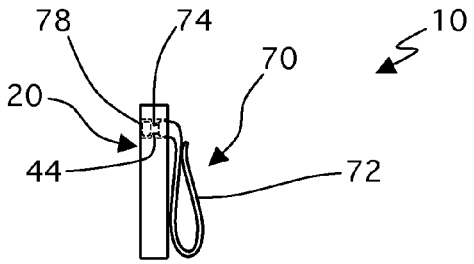
FIG. 7B is a second side view of the first alternate embodiment seen in FIG. 7A assembled.

As seen in FIGS. 7A and 7B, present invention 10 further comprises tension arm assemblies 70. Each tension arm assembly 70 comprises tension arm 72 to receive rim R, seen in FIG. 8A, of headgear H. Extending from tension arm 72 is neck 74 and head 78 at its distal end. Each hole 44 receives its respective head 78. It is noted that a predetermined force is required for hole 44 to receive respective head 78.

Figure 8:
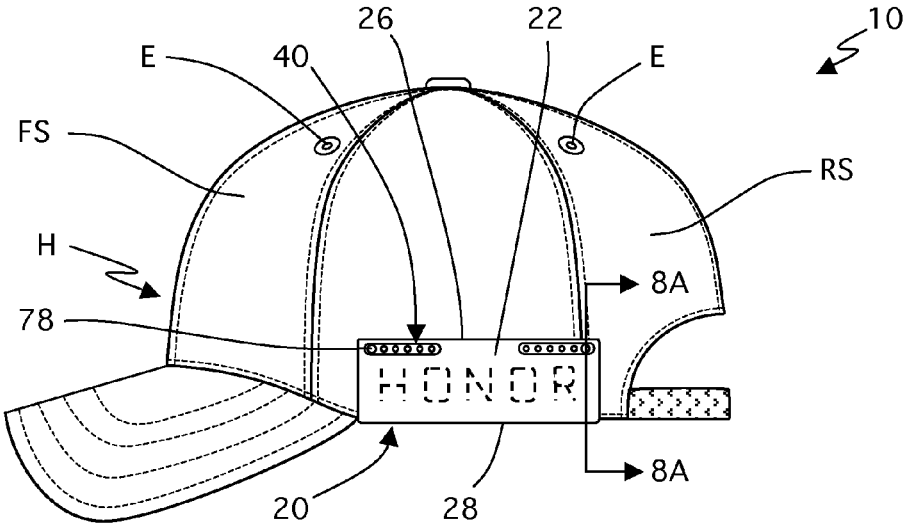
FIG. 8 is a side view of the headgear with the first alternate embodiment of the present invention shown in FIGS. 7A and 7B mounted thereon.
Figure 8A:
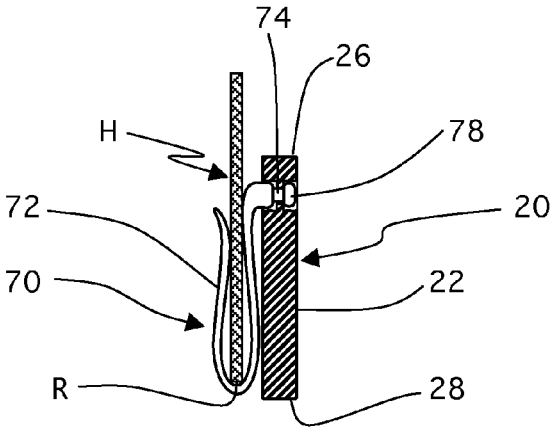
FIG. 8A is a cross section view of the first alternate embodiment of the present invention taken along lines 8A-8A seen in FIG. 8.

As seen in FIGS. 8 and 8A, present invention 10 may be mounted onto rim R of headgear H, whereby tension arm 72 has sufficient tension force to keep present invention 10 securely mounted thereon.

Figure 9A:
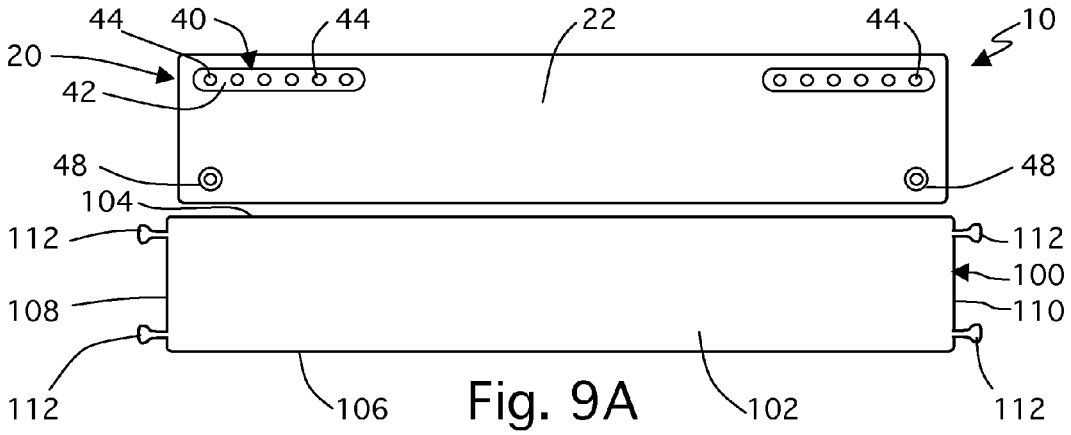
FIG. 9A is a side view of a second alternate embodiment of the present invention disassembled.
Figure 9B:
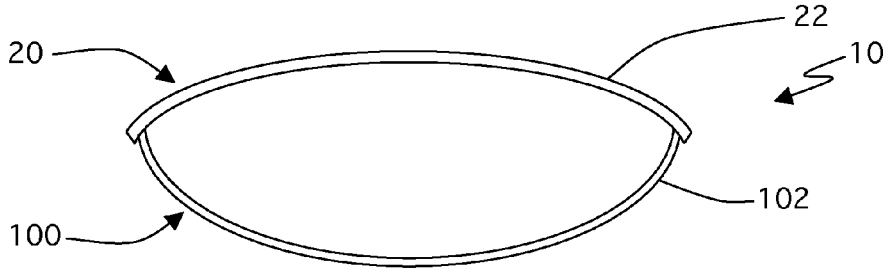
FIG. 9B is a front view of the second alternate embodiment of the present invention assembled.

As seen in FIGS. 9A and 9B, present invention 10 further comprises extension strap 100. In a preferred embodiment, extension strap 100 is of a flexible and bendable semi rigid material. Extension strap 100 has exterior face 102, edges 104 and 106, and lateral edges 108 and 110. Extension strap 100 may have advertisement thereon. Extension strap 100 further comprises tabs 112. In this embodiment, plate assembly 20 further comprises holes 48 that in a preferred embodiment align with the outermost of holes 44. To place in a bracelet configuration, tabs 112 are secured through respective holes 44 and 48.

Figure 10:
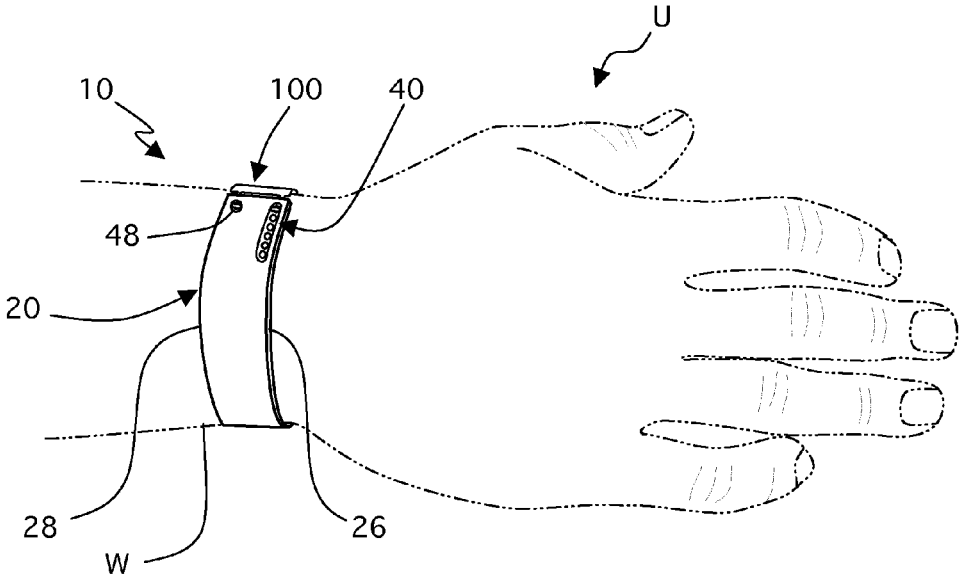
FIG. 10 is an isometric view of the second alternate embodiment of the present invention worn in a bracelet configuration.

As seen in FIG. 10, present invention 10 is worn in the bracelet configuration on wrist W of user U, whereby plate assembly 20 is made of a flexible and bendable semi rigid material that maintains its shape once configured. Plate assembly 20 may also be attached or mounted onto brief cases, purses, luggage, etc.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pinned plate assembly, comprising:

A) a plate assembly made of a flexible and bendable semi rigid material that maintains its shape once configured, said plate assembly has an exterior face, an interior face, first and second edges, and first and second lateral edges, said plate assembly further comprises first and second channels, each said first and second channels comprising at least one hole, said first and second channels each comprise an exterior channel defined at said exterior face, and said first and second channels each comprise an interior channel defined at said interior face; and B) securing means to secure said plate assembly onto headgear.

2. The pinned plate assembly set forth in claim 1, further characterized in that said exterior face displays desired text, letters, symbols, words, logo designs, artwork, or graphics.

3. The pinned plate assembly set forth in claim 1, further characterized in that each said at least one hole extends from said exterior channel to said interior channel.

4. The pinned plate assembly set forth in claim 1, further comprising an advertising band section that is attached to said exterior face with removable/detachable means including hook and loop fasteners, magnets, silicone, and non-permanent glue or adhesives.

5. The pinned plate assembly set forth in claim 4, further characterized in that said advertising band section displays desired text, letters, symbols, words, logo designs, artwork, or graphics.

6. The pinned plate assembly set forth in claim 1, further characterized in that said interior face comprises a reusable interior identification section, wherein personal dedications, identification information, emergency contact information, special or medical conditions, desired text, letters, symbols, words, logo designs, artwork, or graphics is placed thereon.

7. The pinned plate assembly set forth in claim 1, further characterized in that said plate assembly is reversible.

8. The pinned plate assembly set forth in claim 1, further characterized in that said securing means to secure said plate assembly onto said headgear comprises two post assemblies.

9. The pinned plate assembly set forth in claim 8, further characterized in that said two post assemblies removably mount onto said first and second channels.

10. The pinned plate assembly set forth in claim 9, further characterized in that each of said two post assemblies comprises a backing, extending from said backing is post having a neck and a head at its distal end.

11. The pinned plate assembly set forth in claim 10, further characterized in that said at least one hole of said first and second channels are of a cooperative shape and dimension to removably receive a respective said head of said post therein.

12. The pinned plate assembly set forth in claim 8, further characterized in that said plate assembly mounts onto headgear without affecting integrity of said headgear by utilizing existing eyelets to receive said two post assemblies therethrough.

13. The pinned plate assembly set forth in claim 8, further characterized in that said plate assembly mounts onto said headgear when each respective said at least one hole of said first and second channels are aligned with eyelets and from an interior section of said headgear crown, said two post assemblies pass through said eyelets until each respective said at least one hole of said first and second channels receive its respective said head.

14. The pinned plate assembly set forth in claim 1, further characterized in that positions of said at least one hole of said first and second channels are intended to coincide or complement a placement of eyelets in said headgear.

15. The pinned plate assembly set forth in claim 1, further characterized in that said first and second channels accommodate said headgear having eyelets of different dimensions, and distances from each other.

16. The pinned plate assembly set forth in claim 1, further characterized in that said headgear is a soft cap with a rounded crown and a stiff peak projecting in front.

17. The pinned plate assembly set forth in claim 1, further characterized in that said securing means to secure said plate assembly onto said headgear comprises a tension arm assembly.

18. The pinned plate assembly set forth in claim 1, further comprising an extension strap to wear in a bracelet configuration.

* * * * *